United States Patent [19]

Dörling

[11] Patent Number: 4,481,014

[45] Date of Patent: Nov. 6, 1984

[54] ARRANGEMENT FOR PRODUCING GASEOUS PRODUCTS

[75] Inventor: Rolf Dörling, Gummersbach, Fed. Rep. of Germany

[73] Assignee: L. & C. Steinmüller GmbH, Gummersbach, Fed. Rep. of Germany

[21] Appl. No.: 350,337

[22] Filed: Feb. 19, 1982

[30] Foreign Application Priority Data

Feb. 26, 1981 [DE] Fed. Rep. of Germany ..... 3107156

[51] Int. Cl.[3] ..... C10J 3/08

[52] U.S. Cl. ..... 48/76; 48/67; 48/92; 48/DIG. 2; 122/5; 122/6 A; 122/235 N

[58] Field of Search ..... 48/67, 76, DIG. 2, 92; 122/6 A, 5, 235 N

[56] References Cited

U.S. PATENT DOCUMENTS

| | | | |
|---|---|---|---|
| 1,719,874 | 7/1929 | Chapman | 122/235 N |
| 4,314,826 | 2/1982 | Vollhardt | 48/67 X |
| 4,328,007 | 5/1982 | Rafael | 122/5 X |

*Primary Examiner*—Arthur D. Kellogg

*Attorney, Agent, or Firm*—Becker & Becker, Inc.

[57] ABSTRACT

An arrangement for producing gaseous products from solid and liquid, ash-containing fuels and mixtures thereof in an air stream in a reactor. The fuels are introduced into the reactor parallel to the axis thereof. The solid and liquid ash constituents are extensively separated from the gaseous products of the fuel in a slag bath before further cooling-off. The gaseous products are reversed by 180° after leaving the reactor, and subsequently flow into one or more consecutively or parallel connected annular chambers, which are provided with heat exchanger heating surfaces and concentrically surround the reactor. The gaseous products are cooled in these annular chambers.

9 Claims, 3 Drawing Figures

ARRANGEMENT FOR PRODUCING GASEOUS PRODUCTS

The present invention relates to an arrangement for producing gaseous products from solid and liquid, ash-containing fuels and mixtures thereof in an air stream in a reactor; the fuels are introduced into the reactor parallel to the axis thereof and the solid and liquid ash constituents are extensively separated from the gaseous products thereof in a slag bath before further cooling-off.

The production of gaseous products from solid and gaseous, ash-containing fuels and mixtures thereof in an air stream in a reactor is known. The produced gaseous products are loaded with solid and liquid ash constituents, which require measures for separating them off. Measures for separating the solid and liquid ash constituents from the produced gaseous products are provided externally of the reactor according to the known state of the art. Special apparatus is utilized. Separating the solid and liquid constituents with external measures requires considerable design and construction expense, as well as extra space.

It is an object of the present invention to provide an arrangement for producing gaseous products from solid and liquid, ash-containing fuels and mixtures thereof in an air stream in a reactor; the arrangement, in a compact construction an extensive separation of solid and liquid ash constituents from the produced gaseous products, and the arrangement reduces contamination or fouling of the heat exchanger heating surfaces to a sufficient extent during subsequent cooling.

This object, and other objects and advantages of the present invention, will appear more clearly from the following specification in connection with the accompanying drawings, in which.

Figure 1:
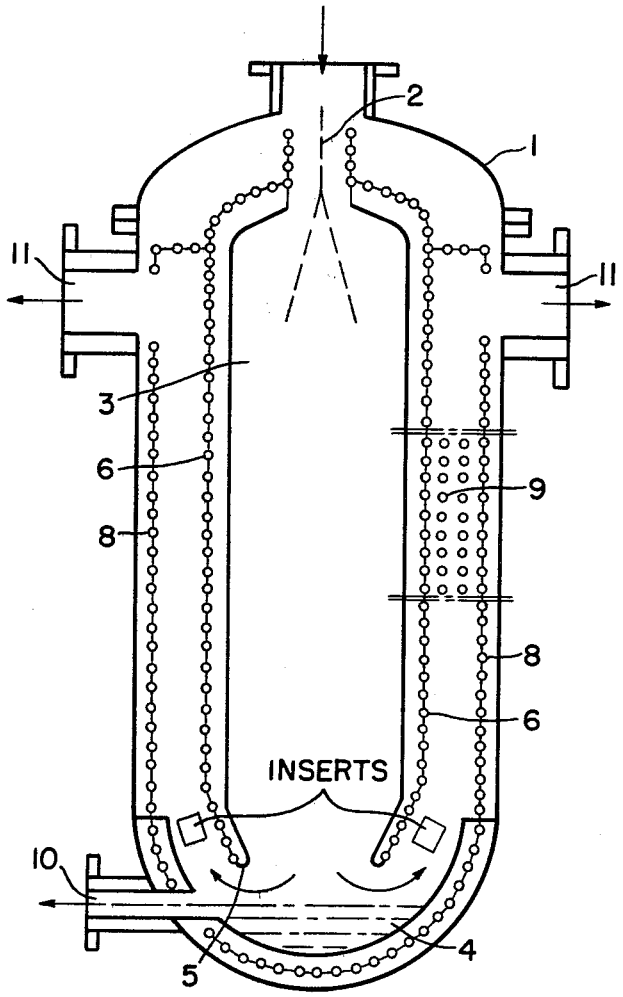
FIG. 1 shows one embodiment of an arrangement according to the present invention, and in particular is a longitudinal section with heat exchanger surfaces arranged in an annular chamber on the right side, and showing the annular chamber without the heat exchanger surfaces on the left side.

The arrangement of the present invention is characterized primarily in that the gaseous products, which are loaded with solid and liquid ash constituents, are reversed by 180° after leaving the reactor, and subsequently flow into one or more consecutively or parallel connected annular chambers which concentrically surround the reactor and are provided with heat exchanger heating surfaces; the gaseous products are cooled in these annular chambers.

The introduction into the reactor of the fuels which are to be reacted can occur in different ways. According to a first embodiment of the present invention, the fuels can be introduced into the reactor in an axially parallel flow from top to bottom through the reactor, and can, as a product flow, be reversed by 180° directly above the slag mass which is arranged below the reactor.

According to another embodiment of the present invention, the fuels which are to be reacted and which are introduced into the reactor can also flow axially parallel from below to the top through the reactor, with the product flow, after extensive separating off of the solid and liquid ash constituents within the reactor in a slag bath arranged in the bottom of the reactor, being reversed in the upper region of the reactor by 180°.

With both inventive embodiments, the product flow in a further arrangement according to the present invention can be cooled off in the region of the 180° reversal by the addition of a coolant flow.

The one or more annular chambers may be provided internally and externally with heating surfaces, with the inner heating surface simultaneously serving as the support structure for the reactor brick lining, and receiving or absorbing the forces arising as a result of the pressure difference between the reactor and the annular chambers.

It is also within the scope of the present invention that the heat exchanger heating surfaces in an annular chamber be constructed as radiation heating surfaces and/or as contact heating surfaces.

The present invention further also allows for the provision of inserts wich influence the material flow in the discharge-flow region of the reactor as well as in the inlet-flow region of the annular chamber. It is also within the scope of the present invention to line the heating surfaces with thermally insulating layers in the lower region of the annular chamber.

The manner of operation of the arrangement in accordance with the present invention can also occur loaded. In such a situation, according to the present invention, the outer heating surfaces of the outermost annular chamber are surrounded by a pressure tank.

The advantages which are attained with the present invention consist in that as a result of the 180° reversal of the produced gaseous product, which is loaded with solid and liquid ash constituents, which reversal can occur one or more times, the solid and liquid ash constituents are separated off to a sufficient extent, and the contamination or fouling of the heating surfaces is reduced to a minimum during the subsequent cooling of the produced gas. Also decisively advantageous is the special arrangement of the heat exchanger surfaces relative to the reactor, which surfaces are located concentrical to the reactor and accordingly permit a compact construction with optimization of the product gas treatment.

Referring now to the drawings in detail, FIG. 1 shows the unit or arrangement 1 in which solid and liquid, ash-containing fuels and mixtures thereof are introduced parallel to the axis of the reactor via the inlet location 2 to the uppermost part of the reactor 3; the fuel is reacted, especially gasified or vaporized. The gaseous products leaving the reactor 3 in a downward flow are reversed in their flow direction by 180°, directly above the slag bath 4 located below the reactor 3, at the location 5 of the inner heating surface 6 which surrounds the reactor 3; from there, the products pass into the annular chamber formed between the outermost heating surface 8 and the inner heating surface 6. As illustrated in the left half of the longitudinal section of FIG. 1, the gaseous products leave the annular chamber of the arrangement 1 uncooled, via the outlet connection 11. In accordance with the right half of the longitudinal section of the same figure, there is provided a heat exchanger 9, embodied as a radiation- and/or as a contact heating surface, for cooling the gas in the annular chamber formed by the outer and inner heating surfaces 6 and 8. The solid and liquid ash constituents precipitated or separated-off in the region of the reversal location 5 are carried out via the slag bath 4 and the discharge outlet 10 of the arrangement 1.

Figure 2:
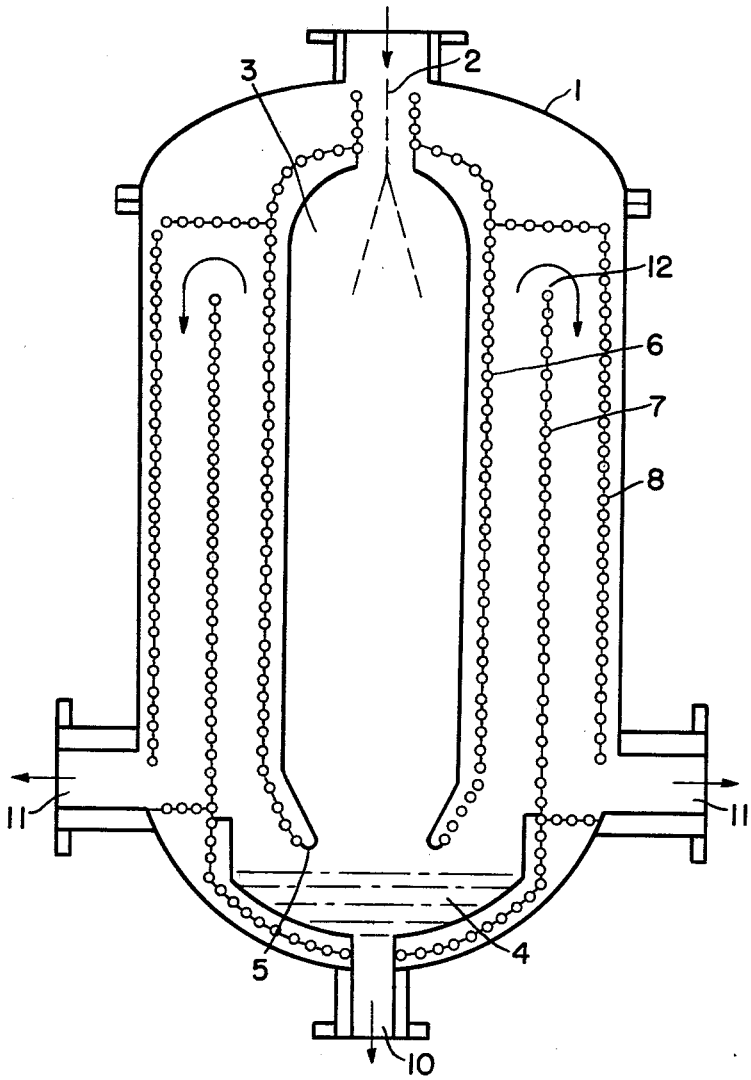
FIG. 2 shows an embodiment of the arrangement according to the present invention with two annular chambers arranged concentrically around the reactor.

FIG. 2 shows the arrangement 1 in a further embodiment, with two annular chambers surrounding the reactor 3 and being formed by the wall heating surfaces 6, 7 and 8; also provided is a further 180° reversal location 12 at the upper edge of the central wall heating surface 7.

Figure 3:
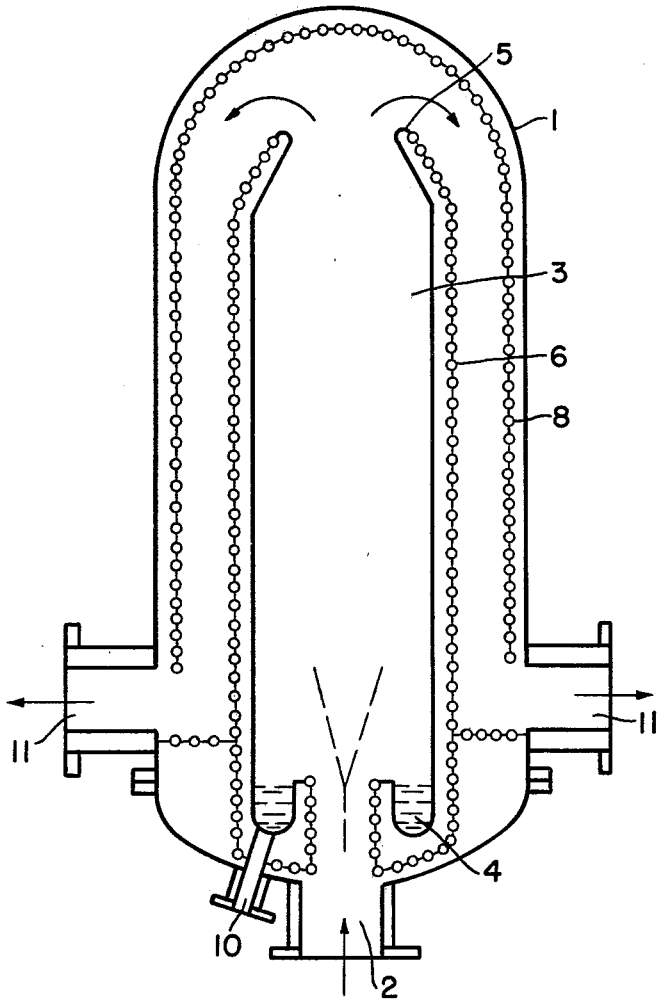
FIG. 3 shows the arrangement according to FIG. 1 with reverse flow of the process media.

In another embodiment, according to FIG. 3, the reactor of the arrangement 1 has flow therethrough in an upward stream. The gaseous products leave the reactor at its highest location, where they are inventively reversed by 180° at the location 5 of the wall heating surface 6. The products are conveyed into the annular chamber formed by the wall heating surfaces 6 and 8, from where they leave the arrangement 1 via the outlet connection 11. The embodiment of the arrangement according to the present invention as illustrated in FIG. 3 can be modified with respect to the annular chamber which surrounds the reactor 3 in a manner analogous to that illustrated in FIG. 2.

The present invention is, of course, in no way restricted to the specific disclosure of the specification and drawings, but also encompasses any modifications within the scope of the appended claims.

What I claim is:

1. An arrangement for producing gaseous products from solid and liquid, ash-containing fuels and mixtures thereof in an air stream in a reactor, said arrangement in combination comprising:

a reactor provided with an inlet means which permits introduction of said fuel parallel to the axis of said reactor, said fuels being reacted in said reactor to form gaseous products which contain solid and liquid ash constituents;

a slag bath located beneath said reactor for receiving solid and liquid ash constituents, extensively separated-off from said gaseous products, prior to any further cooling-off of said gaseous products and with that to prevent any fouling therein;

a discharge outlet means associated with said slag bath for carrying off said separated-off solid and liquid ash constituents;

at least two spaced apart heat exchanger heating surfaces which concentrically surround said reactor and structurally form at least one annular chamber for open passage therebetween; deflection means for reversal in direction of said flow from said reactor to the annular chamber by 180°, said heating surface being kept from fouling due to any solid and liquid ash constituents positively separated due to said reversal in direction prior to reaching said heat exchanger heating surfaces, said at least one annular chamber being arranged in such a way that it receives a flow of said gaseous products from said reactor only after a reversal in direction of said flow by 180°, said gaseous products when extensively cleansed of solid and liquid as constituents then being cooled in said at least one annular chamber by giving off heat to said heat exchanger heating surfaces; and an outlet connection associated with said at least one annular chamber for the discharge of cooled-off gaseous products therefrom.

2. An arrangement in combination according to claim 1, which includes means for a coolant flow for cooling said gaseous product flow in the vicinity of said 180° reversal.

3. An arrangement in combination according to claim 2, in which said heating surfaces are arranged internally and externally of said at least one annular chamber, with said internal heating surface simultaneously serving as a support structure for a brick lining of said reactor, and also as means absorbing forces resulting from the pressure difference between said reactor and said at least one annular chamber.

4. An arrangement in combination according to claim 3, in which said heat exchanger heating surfaces are at least one of radiation heating surfaces and contact heating surfaces.

5. An arrangement in combination according to claim 4, which includes inserts which affect said flow of said gaseous products and are located in the vicinity of said 180° reversal between said reactor and said annular chamber.

6. An arrangement in combination according to claim 5, in which said heating surfaces are lined with thermally insulating layers in the vicinity of said 180° flow reversal of said gaseous products.

7. An arrangement in combination according to claim 6, in which the outermost heating surface is surrounded by a pressure tank.

8. An arrangement in combination according to claim 7, in which reactor has a vertically oriented axis, with said inlet means being arranged at the top of said reactor; and in which said annular chamber is arranged in such a way that said 180° flow reversal of said gaseous products is directly above said slag bath.

9. An arrangement in combination according to claim 7, in which said reactor has a vertically oriented axis, with said inlet means being arranged at the bottom of said reactor; and in which said annular chamber is arranged in such a way that said 180° flow reversal of said gaseous products is at the top of said reactor.

* * * * *